United States Patent [19]

Walker

[11] 3,982,547

[45] Sept. 28, 1976

[54] SKIRT, OR SLACKS SUPPORTING BRASSIERE

[76] Inventor: Amy Thelma Walker, 5422 Hawthorne Place, Washington, D.C. 20016

[22] Filed: June 11, 1975

[21] Appl. No.: 586,022

[52] U.S. Cl. ..... 128/452; 128/510; 2/300

[51] Int. Cl.[2] ..... A41C 3/00

[58] Field of Search ..... 128/430, 435, 436, 437, 128/450, 452, 454, 483, 487, 494, 510, 438; 2/300, 305, 310

[56] References Cited

UNITED STATES PATENTS

| | | | |
|---|---|---|---|
| 1,448,970 | 3/1923 | Leverence | 2/305 |
| 2,136,768 | 11/1938 | Willis et al. | 128/437 |
| 2,700,767 | 2/1955 | Groocock et al. | 128/454 |
| 3,478,747 | 11/1969 | Sachs | 128/483 |

*Primary Examiner*—Werner H. Schroeder
*Assistant Examiner*—Doris L. Troutman
*Attorney, Agent, or Firm*—Pearson & Pearson

[57] ABSTRACT

An undergarment which fits over a slip and under a blouse supports the waist band of a skirt or of a pair of slacks. The undergarment is a brassiere with conventional bust cups, band encompassing the chest and attachable at the back and a pair of elastic shoulder straps. The shoulder straps have an adjustable length pair of front extensions with clips to grip the front of the waist band. The straps cross in the upper front of the brassiere and thence extend in parallelism through loops in the chest band down the back to clips supporting the rear of the waist band.

5 Claims, 5 Drawing Figures

SKIRT, OR SLACKS SUPPORTING BRASSIERE

BACKGROUND OF THE INVENTION

It has heretofore been proposed to provide straps on a brassiere type undergarment usually for supporting another undergarment such as a girdle, panty hose or the like. For example, in U.S. Pat. No. 3,411,508 to Sayers of 1968, straps depend downwardly from the sides of the bust cups to the sides of the girdle waist band. U.S. Pat. No. 2,389,450 to Moy of Nov. 20, 1945 also teaches side straps from brassiere to girdle.

U.S. Pat. No. 2,520,772 to Mayer of Aug. 29, 1950 and U.S. Pat. No. 2,538,709 to Rosner of Jan. 15, 1951 both disclose brassieres with front suspension tabs and rear suspension tabs for attachment to a girdle or corset.

However, as far as I am aware, the prior art does not disclose a brassiere capable of comfortably supporting a skirt, or a pair of slacks, perhaps for the reason that the tabs, or straps are secured at front and back of the brassiere rather than slidable at the back to yield and conform to changes of position.

SUMMARY OF THE INVENTION

In this invention the brassiere is provided with bust cups and a band encompassing the chest of the wearer at the level of the bottom of the bust cups. A pair of shoulder straps are crossed in the upper portion between the bust cups and firmly secured along the inner upper periphery of the bust cups for uplift purposes. Suspension strap extensions to the shoulder straps extend downwardly, each below a bust cup, to clips which grip the waist band, of a skirt or slacks. The shoulder straps extend from the upper centre of the bust cups up over the shoulders and down the back, in parallelism, through loops in the chest band to rear clips for gripping the rear of the waistband. When the wearer moves, the elastic shoulder straps, which are elastic, are movable, yieldable and slidable in the loops to readily accomodate to the movements of the wearer.

DESCRIPTION OF A PREFERRED EMBODIMENT

Figure 1:
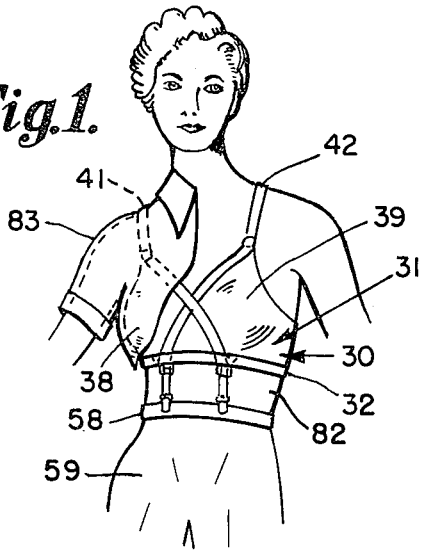
FIG. 1 is a front perspective elevation showing a brassiere undergarment of my invention on a wearer.
Figure 2:
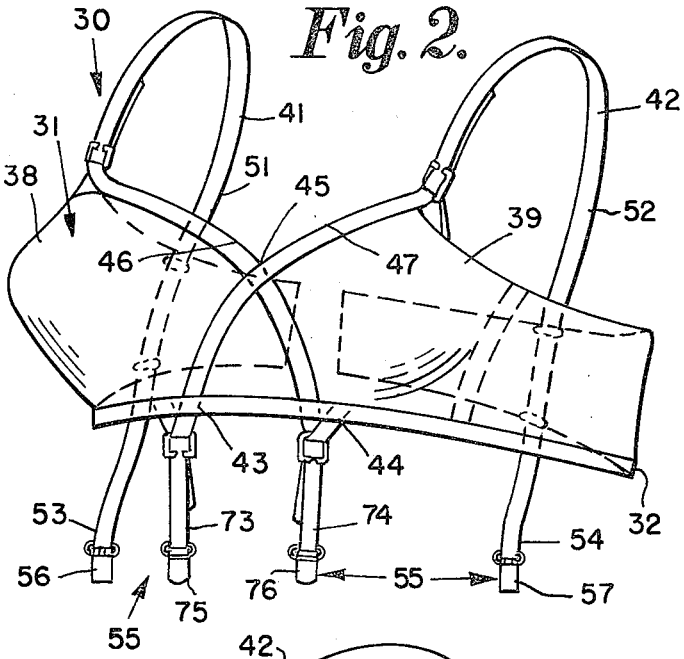
FIG. 2 is an enlarged front perspective view of the undergarment of the invention.
Figure 3:
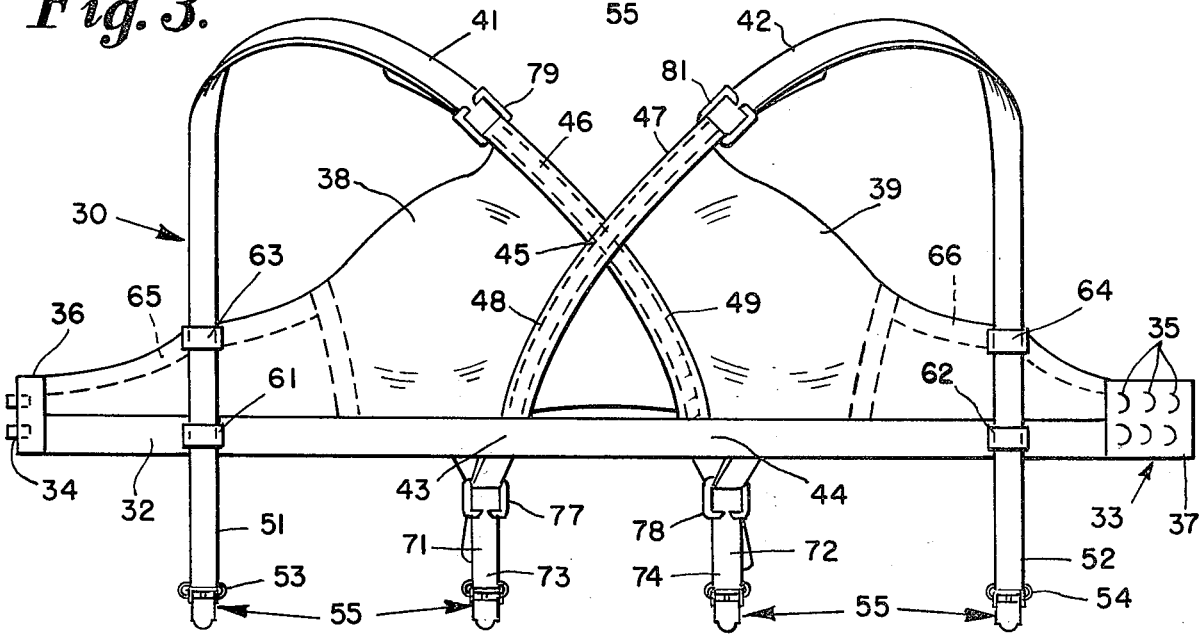
FIG. 3 is a front view of the undergarment of the invention.
Figure 4:
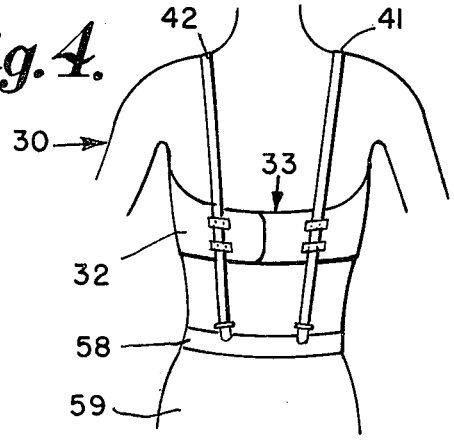
FIG. 4 is a fragmentary rear elevation of the invention.

As shown in the drawing, the brassiere undergarment 30 of this invention includes a body portion 31 having a lower band, or chest band 32 adapted to encompass the chest of the wearer and having fastening means 33, at the back of the wearer, such as hooks 34 and eyes 35, at the opposite ends 36 and 37 of the chest band. A pair of bust cups 38 and 39 extend upwardly from the chest band, or lower strap, 32.

Brassiere undergarment 30 includes a pair of shoulder straps 41 and 42 each firmly secured at a point of attachment 43 or 44 to the chest band 32, the points of attachment being below the central areas of the bust cups. Straps 41 and 42 are of elastic, stretchable, resilient material and are crossed over each other at 45 proximate, the upper centre of the body portion 31, between the cups 38 and 39. Straps 41 and 42 thus extend upwardly from the points of attachment 43 and 44 to the crossing point 45 and thence along the upper peripheral edges 46 and 47 of the bust cups and are firmly secured thereto by sewing stitches 48 and 49. Straps 41 and 42 thence extend over the shoulders and down the back of the wearer, in substantial parallelism as at 51 and 52, to the lower terminal ends 53 and 54, which carry gripping and supporting means 55 in the form of spring clips 56 and 57 which are at waist level and support the waist band 58 of the slacks 59.

At least one pair of loops 61 and 62, and preferably a second pair of loops 63 and 64 are provided on the rear of the chest band 32 which slidably receive the downwardly extending portions 51 and 52 of the shoulder straps 41 and 42 and permit them to slide and yield in response to body motion of the wearer. The lower pair of loops 61 and 62 are affixed to the chest band 32 and the upper pair of loops 63 and 64 are affixed to a trim band 65 or 66 to give strength to the assembly.

A pair of front extension straps 71 and 72 are each affixed proximate one of the points of attachment 43 or 44 to the chest band 32 and depend downwardly in parallelism to terminal ends 73 and 74 at waist level, the ends 73 and 74 carrying fastening means 55 in the form of spring clips 75 and 76 for gripping and supporting the front of the waist band 58 of slacks 59.

Length adjusting means of a well known type are provided on shoulder straps 41 and 42 and on front extension straps 71 and 72 as shown at 77, 78, 79 and 81.

The brassiere undergarment 30 may be worn over a slip 82, and under a blouse 83, for supporting a skirt, or the slacks 59 without applying pressure on the waist or abdomen such as is created by a conventional waist belt.

Figure 5:
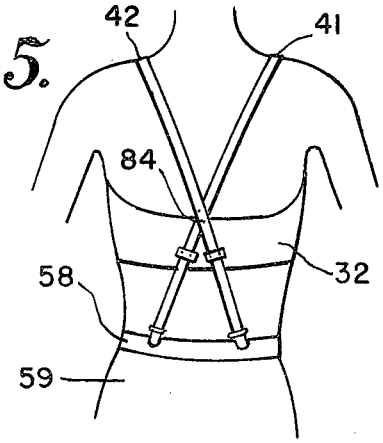
FIG. 5 is a view, similar to FIG. 4, of a modification.

As shown in FIG. 5, the rear portions 41 and 42 of the shoulder straps may advantageously be crossed as at 84 to provide additional flexibility of body motion.

I claim:

1. In combination a brassiere having a lower chest band adapted to encompass the chest of the wearer; a body portion with a pair of bust cups extending upwardly from said lower chest band, the opposite ends of said band having fastening means at the rear of said chest, a pair of shoulder straps, each extending upwardly, from a point of attachment to said chest band under one said cup, diagonally along the upper edge of the other said bust cup and thence over the shoulder of a wearer and thence downwardly of the back of the wearer to waist level and having a rearward spring clip at the lower terminal end thereof;

at least one pair of loops, each affixed to said chest band on an opposite side of the centre of the back of said chest band and slidably receiving one of said downwardly extending shoulder straps;

and a pair of adjustable length straps, each extending downwardly from a point of attachment of a shoulder strap with said chest band to waist level and having a forward spring clip at the lower terminal end thereof, said rearward and forward clips being adapted to engage and support the waist band of a lower garment of the skirt, or slack, type.

2. In combination with a pair of ladies' slacks, a brassiere undergarment for supporting said slacks, said brassiere undergarment having:

a pair of bust cups;

a pair of shoulder straps, of elastic material, crossing each other proximate the upper front centre of said brassiere and securely attached proximate the lower front thereof, each on an opposite side of the centre thereof, said shoulder straps having front strap extensions, of said elastic material, extending downwardly in parallelism to waist level each from the lower front portion of said brassiere, below the centre of a bust cup;

said shoulder straps extending over the shoulders of the wearer and thence downwardly to waist level of the wearer;

and at least one pair of loops on the rear of said brassiere, each for slidably receiving one of said shoulder straps, and means at the lower ends of said shoulder straps, and of said shoulder strap extensions, for gripping and supporting said slacks.

3. A combination as specified in claim 2 wherein:

said shoulder straps cross each other, in rear of the wearer above the level of said loops on the rear of said brassiere.

4. An undergarment fitting over a slip and under a blouse, said undergarment comprising:

a brassiere having a pair of bust cups and an elastic chest band extending around the chest of the wearer for attachment at the back thereof, a pair of elastic shoulder straps, each including length adjustment means, and each extending from waist level, in parallelism, upwardly to an opposite side of the front of said chest band and attached thereto, thence extending upwardly and crossing each other near the top front of said brassiere and thence extending over the shoulders and down the back of the wearer to waist level;

said shoulder straps terminating at each opposite end in fasteners adapted to engage and support the waist band of a pair of slacks.

5. An undergarment as specified in claim 4 wherein:

said elastic chest band of said brassiere includes at least one pair of loops, each on an opposite side of the centre of the back of the wearer and slidably receiving one of said shoulder straps.

* * * * *